US010555658B2

(12) United States Patent
Metzel et al.

(10) Patent No.: US 10,555,658 B2
(45) Date of Patent: Feb. 11, 2020

(54) TWIST MOP WITH INTEGRAL PAWL

(71) Applicant: Freudenberg Household Products LP, Aurora, IL (US)

(72) Inventors: Doug Metzel, Berwyn, IL (US); Conrad Alfaro, Bolingbrook, IL (US)

(73) Assignee: Freudenberg Household Products LP, Aurora, IL (US)

( * ) Notice: Subject to any disclaimer, the term of this patent is extended or adjusted under 35 U.S.C. 154(b) by 544 days.

(21) Appl. No.: 14/597,975

(22) Filed: Jan. 15, 2015

(65) Prior Publication Data

US 2016/0206171 A1 Jul. 21, 2016

(51) Int. Cl.
*A47L 13/142* (2006.01)
*A47L 13/24* (2006.01)
*A47L 13/20* (2006.01)

(52) U.S. Cl.
CPC ..... *A47L 13/142* (2013.01); *A47L 13/20* (2013.01); *A47L 13/24* (2013.01)

(58) Field of Classification Search
CPC ..... A47L 13/142; A47L 13/20; A47L 13/24
USPC ..... 15/120.1, 120.2, 119.1
See application file for complete search history.

(56) References Cited

U.S. PATENT DOCUMENTS 6,212,728 B1 * 4/2001 Facca ..... A47L 13/142 15/120.1
6,427,280 B1 * 8/2002 Specht ..... A47L 13/142 15/119.1
6,625,838 B2 * 9/2003 Laux ..... A47L 13/142 15/120.1
6,732,396 B2 * 5/2004 Laux ..... A47L 13/142 15/116.1
2008/0092315 A1 * 4/2008 Lin ..... A47L 13/142 15/120.1

FOREIGN PATENT DOCUMENTS

CN 201481330 U * 5/2010

* cited by examiner

*Primary Examiner* — Laura C Guidotti
*Assistant Examiner* — Thomas Raymond Rodgers
(74) *Attorney, Agent, or Firm* — Leydig, Voit & Mayer, Ltd.

(57) ABSTRACT

A mop comprising a mop handle with a grip end and a mopping end and includes spline ribs that surround a surface of the mop handle. The mop includes a ratchet sleeve surrounding the mop handle and is rotatable in first and second directions. The ratchet sleeve includes a flexible collar with an inward-facing integral pawl on an interior portion of the flexible collar. The mop includes a mop head at the mopping end of the mop handle. The mop head has a first end connected to the mopping end and a second end connected to the ratchet sleeve. The flexible collar is flexible between a locked position where the pawl engages with the spline ribs preventing rotation of the ratchet sleeve in the first rotational direction, and an unlocked position where the pawl disengages the spline ribs allowing rotation of the ratchet sleeve in first and second rotational directions.

23 Claims, 8 Drawing Sheets

TWIST MOP WITH INTEGRAL PAWL

TECHNICAL FIELD

This patent disclosure relates generally to floor cleaning tools and, more particularly, to a mop.

BACKGROUND

Use of floor cleaning tools, such as mops, brooms, brushes, etc., frequently results in portions of those tools becoming saturated with fluids or soiled with the materials absorbed from the cleaned surface. During use, it can be desirable to wring out or otherwise squeeze the saturated fluids from brushes or mop heads attached to the cleaning tools to continue a cleaning application. At certain times, it may be desirable to remove portions of a cleaning tool, such as a mop head, for cleaning or replacement.

An improved cleaning tool is needed that allows for easy removal of fluids from portions of the floor cleaning tool and easy removal of portions of the cleaning tool for cleaning or replacement.

SUMMARY

The disclosure describes, in one aspect, a mop comprising a mop handle with a grip end and a mopping end. The mop includes a plurality of spline ribs disposed on the mop handle between the grip end and the mopping end. The spline ribs substantially surround a surface of the mop handle and are aligned substantially with the mop handle. The mop includes a ratchet sleeve concentrically surrounding the mop handle so as to be rotatable in first and second rotational directions with respect to the mob handle. The ratchet sleeve includes a flexible collar with an inward-facing integral pawl disposed on an interior portion of the flexible collar facing the mop handle. The mop includes a mop head disposed at the mopping end of the mop handle. The mop head has a first end connected to the mopping end of the mop handle and a second end connected to the ratchet sleeve. The flexible collar of the ratchet sleeve is flexible between a locked position in which the pawl engages with the spline ribs so as to substantially prevent rotation of the ratchet sleeve with respect to the mop handle in the first rotational direction, and an unlocked position, in which the pawl disengages the spline ribs so as to allow rotation of the ratchet sleeve with respect to the mop handle in both the first and second rotational directions.

In another aspect, the disclosure describes a mop comprising a mop handle with a grip end and a mopping end. The mop includes a locking cup disposed on the mopping end of the mop handle. The mop also includes a ratchet sleeve concentrically surrounding the mop handle so as to be rotatable and slidable with respect to the mob handle. The mop also includes a mop head having a first end connected to a locking cap and a second end connected to the ratchet sleeve. The locking cap is configured to selectively engage with the locking cup so as to allow for selective removal of the mop head from the mop handle.

In another aspect, the disclosure describes a mop comprising a mop handle with a grip end and a mopping end. The mop includes a locking cup disposed on the mopping end of the mop handle, and a plurality of spline ribs disposed on the mop handle between the grip end and the mopping end. The spline ribs substantially surround a surface of the mop handle and is aligned substantially with the mop handle. The mop includes a ratchet sleeve concentrically surrounding the mop handle so as to be rotatable with respect to the mob handle. The ratchet sleeve includes a flexible collar with an inward-facing integral pawl disposed on an interior portion of the flexible collar facing the mop handle. The mop also includes a mop head having a first end connected to a locking cap and a second end retained around the ratchet sleeve. The locking cap is configured to selectively engage with the locking cup so as to allow for selective removal of the mop head from the mop handle. The flexible collar is biased toward a locked position in which the pawl engages with the spline ribs so as to substantially prevent rotation of the ratchet sleeve in a first rotational direction with respect to the mop handle. The flexible collar is flexible into an unlocked position in which the pawl disengages the spline ribs so as to allow rotation of the ratchet sleeve with respect to the mop handle in the first rotational direction and a second rotational direction.

DETAILED DESCRIPTION

Figure 1:
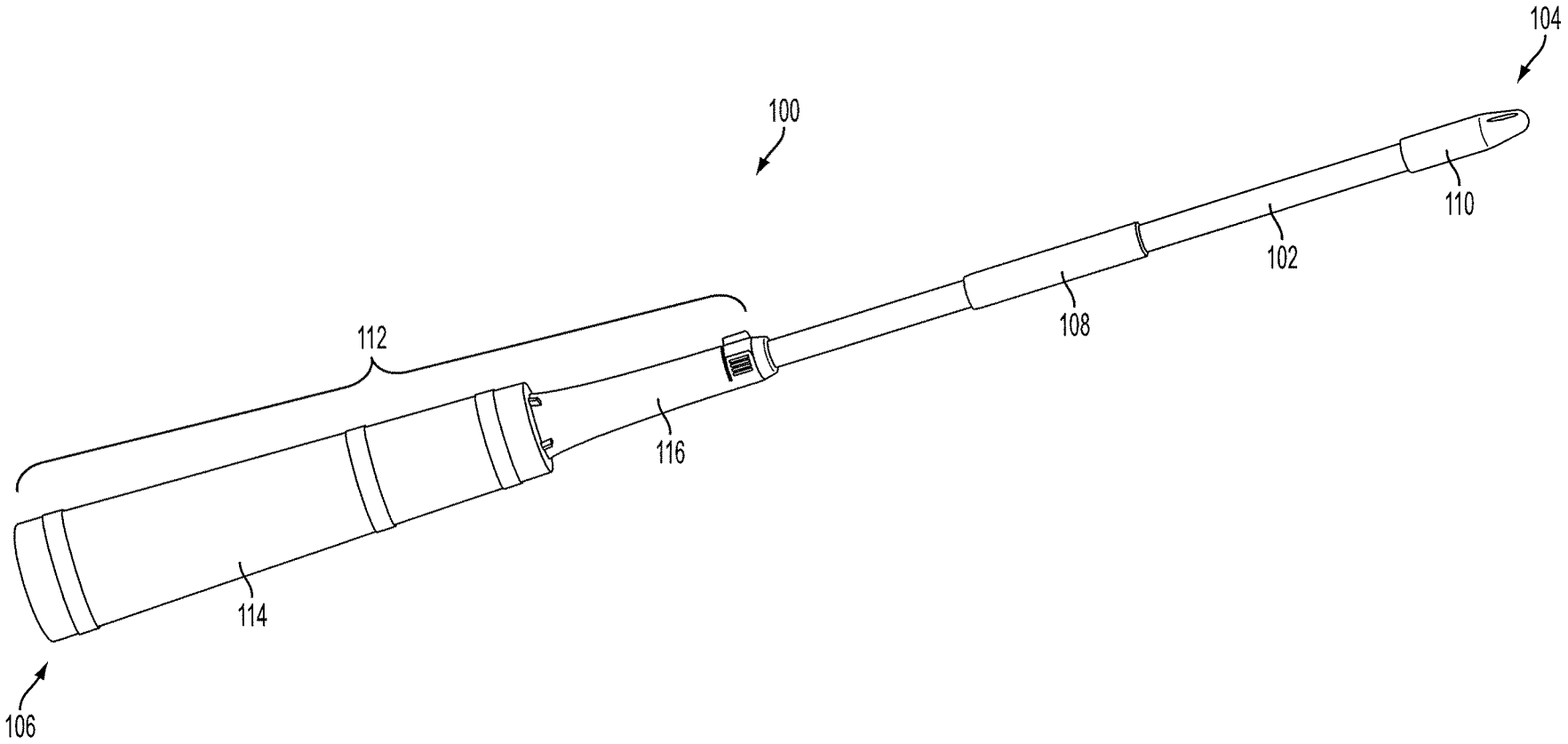
FIG. 1 is a perspective view of a mop in a wringing position in accordance with the disclosure.

This disclosure relates to a mop. Referring to the figures, FIG. 1 shows a mop 100 in accordance with the disclosure. The mop 100 includes a mop handle 102 that has a grip end 104 and a mopping end 106 disposed at opposite ends of the mop handle 102. The mop 100 includes a pad 108 between the grip end 104 and the mopping end 106, and a hanging grip 110 disposed on the grip end. The mop 100 also includes a twist mop assembly 112 disposed on the mopping end 106. The twist mop assembly 112 includes a mop head 114 and a ratchet sleeve 116 connected to one another. The ratchet sleeve 116 concentrically surrounds the mop handle 102 and is rotatable with respect to the mop handle. The mop head 114 includes a plurality of strands 122. It should be understood that the depiction of the mop head 114 in FIGS. 1, 3, 4, 5, 9, and 10 as a solid feature as opposed to a plurality of strands is for illustrative purposes only. In some embodiments, as will be described in further detail below, the ratchet sleeve 116 can be rotated about the mop handle 102 to wring out the mop head 114 during a floor cleaning application.

Figure 2:
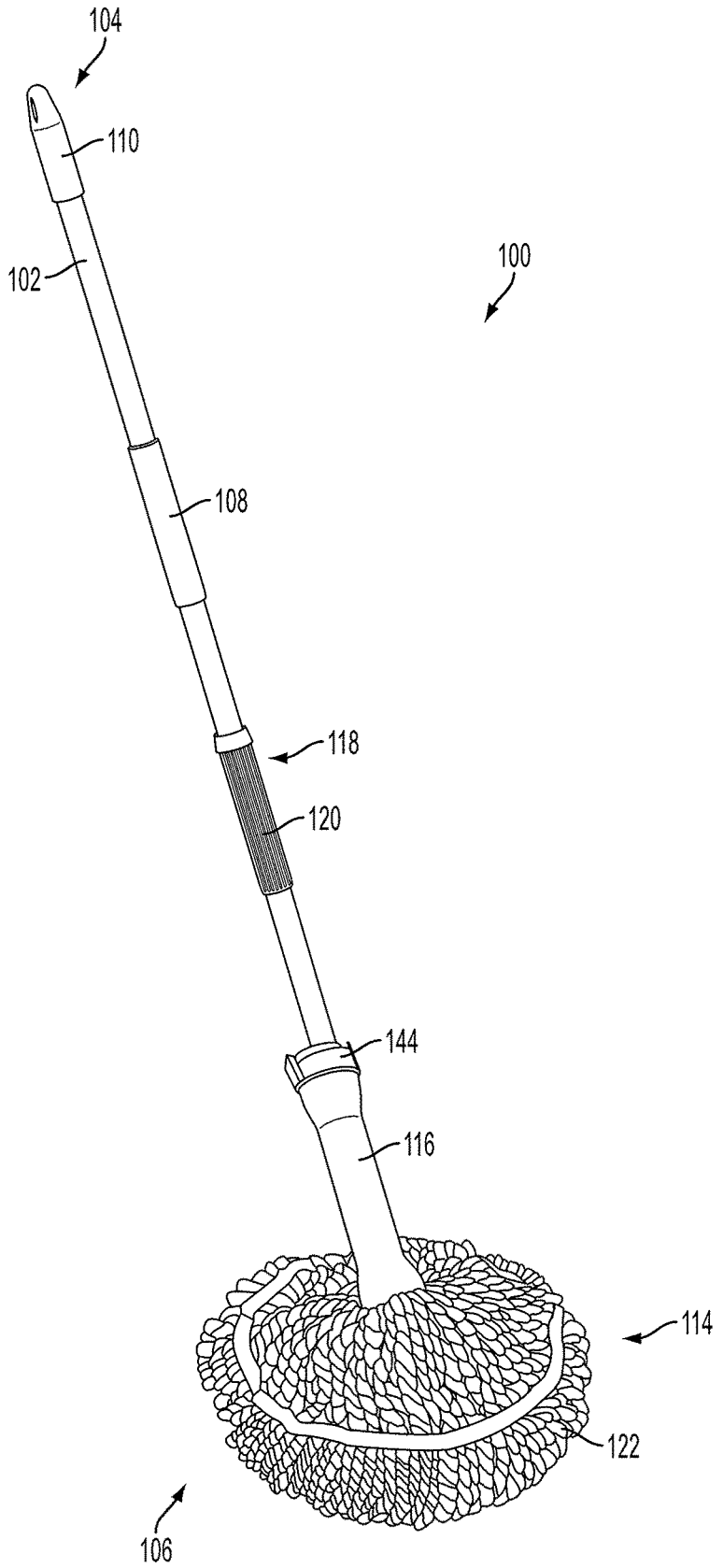
FIG. 2 is a perspective view of the mop of FIG. 1 in a mopping position.

FIG. 1 shows the mop 100 in a wringing position, and FIG. 2 shows the mop 100 in a mopping position in which the ratchet sleeve 116 is disposed near the mopping end 106 and a spline sleeve 118 is shown disposed on the mop handle 102. The spline sleeve 118 includes a plurality of spline ribs 120 that substantially surround a surface of the mop handle 102 and are substantially aligned with mop handle. The spline ribs 120 include a series of ridges and slots between adjacent ridges substantially parallel with one another and substantially aligned with the mop handle 102. Although the spline sleeve 118 in FIG. 2 is shown as a detachable sleeve disposed on the mop handle 102, it is contemplated that the spline ribs can be integral with the mop handle in some embodiments. In the wringing position shown in FIG. 1, the ratchet sleeve 116 is disposed substantially overlapping the spline ribs 120 of the spline sleeve 118, pulling the mop head 114 tight around the mop handle 102. In the mopping position shown in FIG. 2, the ratchet sleeve 116 is disposed between the spline sleeve 118 and the mopping end 106 of the mop handle 102. In the mopping position, the strands 122 of the mop head 114 are substantially relaxed and in position for mopping and other floor cleaning applications.

Figure 3:
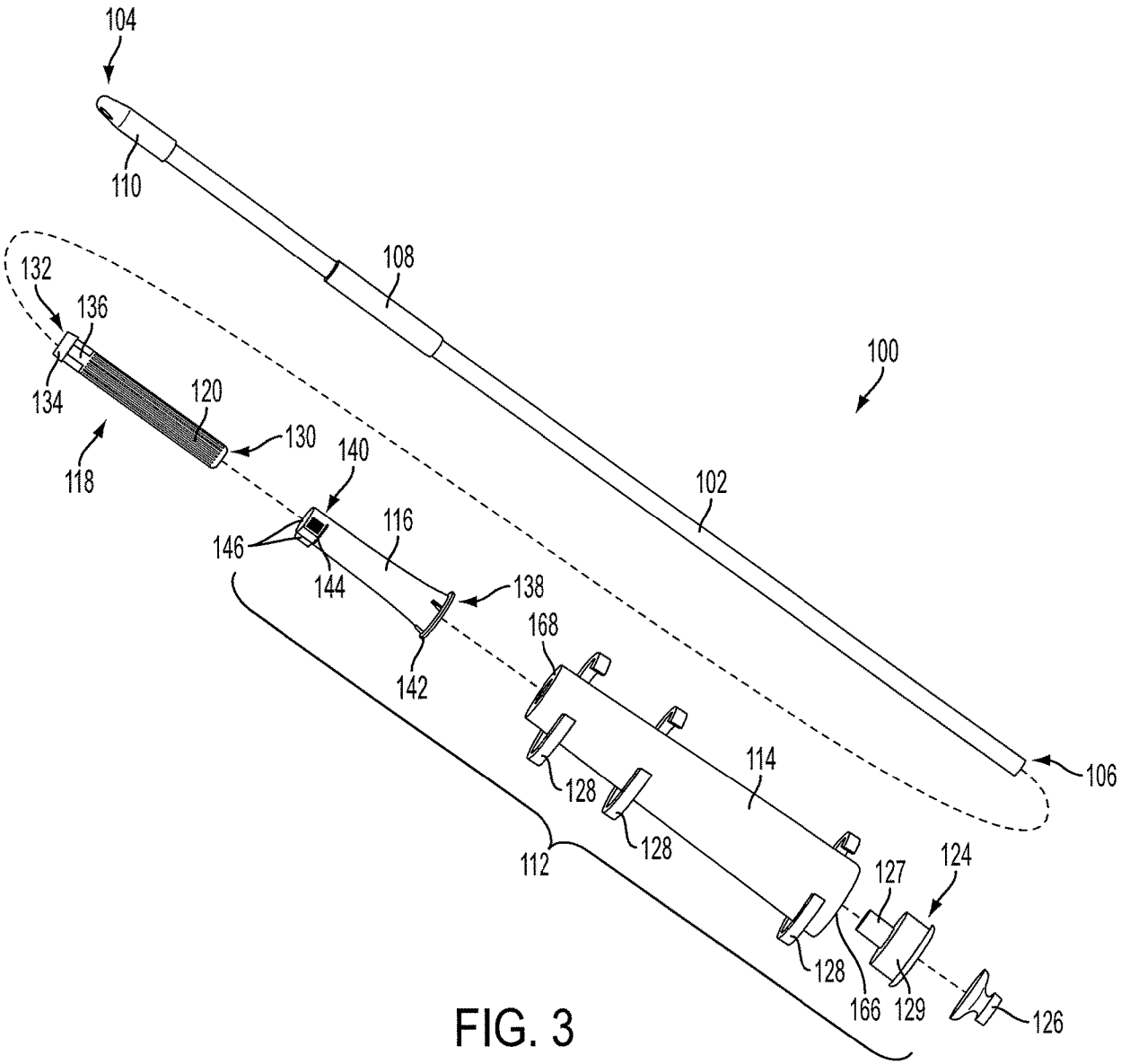
FIG. 3 is an exploded view of the mop of FIG. 1.
Figure 5:
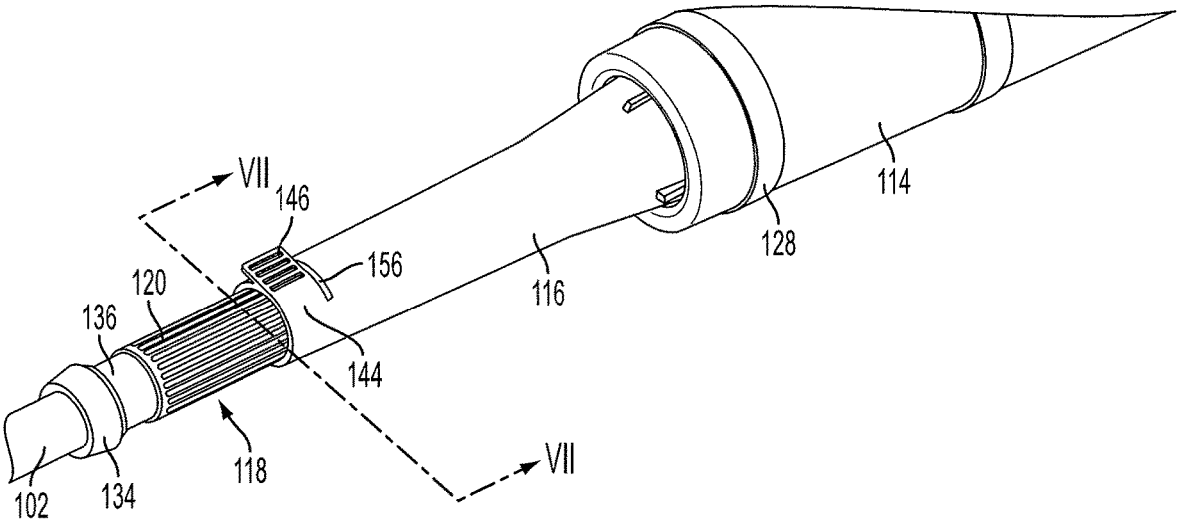
FIG. 5 is a partial perspective view of the mop of FIG. 1.

FIG. 3 shows an exploded view of the mop 100. In addition to the ratchet sleeve 116 and the mop head 114, the twist mop assembly 112 further includes a locking cup 124, a locking cap 126, and a plurality of mop head bands 128. In the embodiment illustrated in FIG. 3, the spline sleeve 118 has a hollow tube shape and fits over the mop handle 102. The spline sleeve 118 can be adhered, press-fit, or otherwise fastened into place between the grip end 104 and the mopping end 106. Spline ribs 120 cover a substantial portion of the spline sleeve 118 between a bottom end 130 and a top end 132. The top end 132 terminates in a stop collar 134 that has a larger diameter than the remainder of the spline sleeve 118, and a larger diameter than at least a portion of the ratchet sleeve 116. Thus, although the ratchet sleeve 116 can slide over the bottom portion 130 of the spline sleeve 118 to substantially overlap the spline ribs 120, the stop collar 134 prevents the ratchet sleeve 116 from sliding fully over the spline sleeve 118 toward the grip end 104 of the mop handle 102. As best seen in FIG. 5, the spline sleeve 118 also has a smooth portion 136 near the top end 132 between the stop collar 134 and the spline ribs 120. Although the smooth portion 136 of the spline sleeve 118 can have ribs in certain embodiments, the smooth portion has fewer ribs than the amount of ribs between the smooth portion and the bottom end 130 of the spline sleeve.

Referring again to FIG. 3, The ratchet sleeve 116, which also has a substantially tubular shape, fits concentrically around the mop handle 102 and can slide up and down between the spline sleeve 118 and the mopping end 106 of the mop handle. The ratchet sleeve 116 is also free to rotate concentrically around the mop handle 102 while between the spline sleeve 118 and the mopping end, but can be selectively restricted from rotating about the spline sleeve under certain conditions.

More specifically, in the illustrated embodiment, the ratchet sleeve 116 includes a retaining end 138 and a pawl end 140. The ratchet sleeve 116 tapers outwardly from the pawl end 140 to the retaining end 138, terminating at the retaining end 138 with a retaining collar 142 protruding radially outward from the ratchet sleeve. The diameter of the ratchet sleeve 116 at the pawl end 140 is at least slightly larger than the diameter of the spline sleeve 118 so as to allow for the ratchet sleeve to slide over the spline sleeve at least until the stop collar 134. The pawl end 140 includes a flexible collar 144 with tabs 146 that can be squeezed toward one another in order to selectively flex the flexible collar between a substantially circular shape and a substantially ovular shape. Although the figures herein show two tabs 146 on the flexible collar 144, embodiments with more or fewer tabs are also contemplated. Additionally, although the illustrated embodiment shows a flexible collar 144 that is at the pawl end 140 of the ratchet sleeve 116, other embodiments in which the flexible collar is disposed at other sections of the ratchet sleeve, or even embodiments in which the entire ratchet sleeve is a flexible collar, are also contemplated herein.

Figure 6:
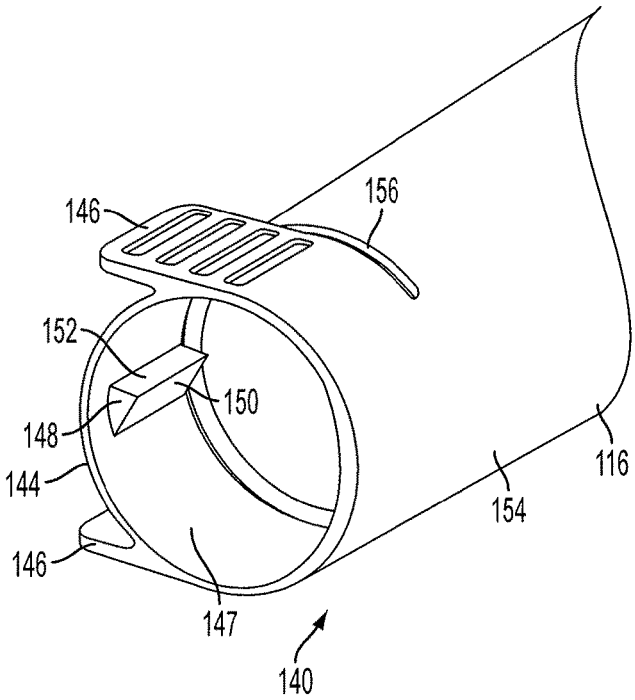
FIG. 6 is a perspective view of an integrated pawl of the mop of FIG. 1 in accordance with the disclosure.

As best shown in FIG. 6, the flexible collar 144 includes an inward-facing integral pawl 148 disposed on an interior portion 147 of the flexible collar facing the mop handle 102. The pawl 148 is substantially wedge-shaped, having an angled portion 150 and a stopping portion 152. In the embodiment illustrated in FIG. 6, the stopping portion 152 of the pawl 148 projects substantially perpendicularly from the interior portion 147 of the flexible collar 144. The flexible collar 144 itself is partially integral with the remainder of the ratchet sleeve 116 and connects to the ratchet sleeve via a bridge 154. At least a portion of the flexible collar 144, however, is separated from the ratchet sleeve 116 by a collar slit 156 formed between the ratchet sleeve and the flexible collar. In the illustrated embodiment, the pawl 148 is disposed along the interior surface 147 of the flexible collar 144 substantially opposite the bridge 154 and substantially between the two tabs 146. Thus, when a user applies force to the tabs 146, for example, squeezing the tabs toward one another, the flexible collar 144 can flex from a substantially circular shape, as shown in FIG. 6, to an ovular shape that moves the pawl 148 further from the bridge 154. In some embodiments, the flexible collar 144 is biased into a substantially circular shape such that it will spring back into a substantially circular shape when the force applied to the tabs 146 is released.

Figure 7:
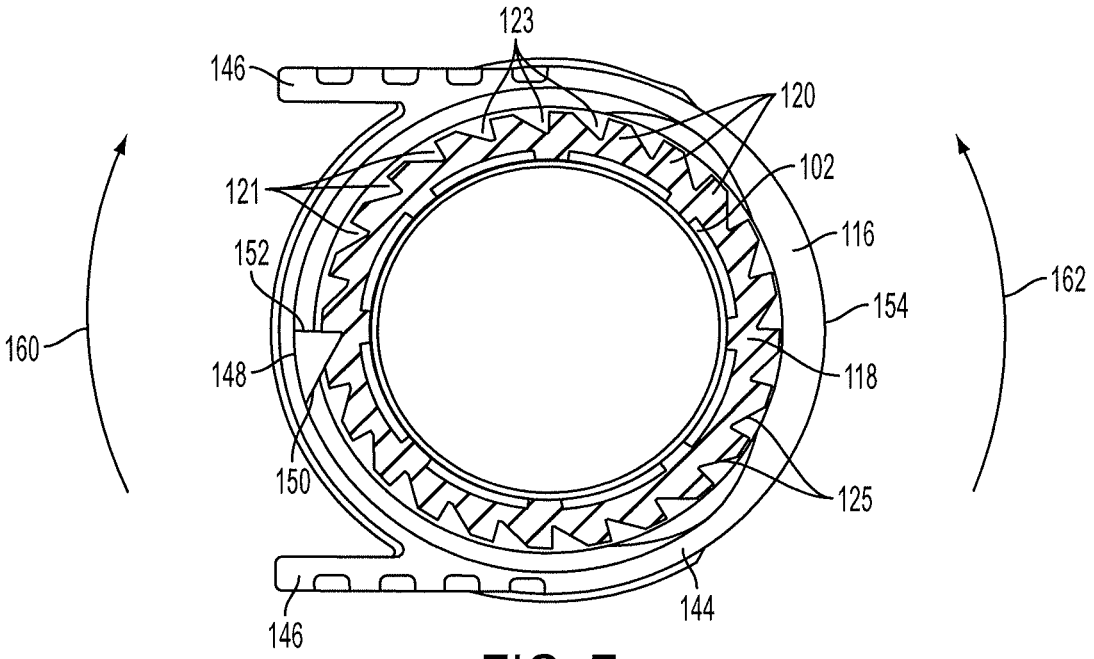
FIG. 7 is a sectional view of the mop of FIG. 1, as indicated in FIG. 5, showing the integrated pawl in a locked position.

As shown in FIG. 5, the flexible collar 144 of the ratchet sleeve 116 can slide over the spline sleeve 118. The diameter of the flexible collar 144 is such that the flexible collar can slide over the spline ribs 120, but that the pawl 148 extends inward toward the spline sleeve 118 in an engaging relationship with the spline ribs. The selectively engaging relationship between the pawl 148 and the spline ribs 120 can be seen in FIGS. 7 and 8. Specifically, FIG. 7 shows a cross section of the mop 100 with the ratchet sleeve 116 disposed to concentrically surround the spline sleeve 118 mounted on the mop handle 102. In FIG. 7, the flexible collar 144 is in a locked position in which the pawl engages with the spline ribs 120 so as to substantially prevent rotation of the ratchet sleeve 116 with respect to the mop handle 102 in a first rotational direction 160. In the locked position, the pawl 148 is disposed in one of a plurality of valleys 121 formed between adjacent spline ribs 120 such that the stopping portion 152 of the pawl abuts a wall portion 123 of a spline rib. Although the illustrated embodiment includes only a single pawl engaged with a single spline rib at a time, other embodiments that include multiple pawls engaged with multiple spline ribs are also contemplated herein.

When in the locked position, such as in the embodiment shown in FIG. 7, the ratchet sleeve 116 is prevented from rotating with respect to the mop handle 102 in a first rotational direction 160, but can be rotated with respect to the mop handle in a second rotational direction 162. As shown, the angled portion 150 of the pawl 148 can slide against a sloped portion 125 of the spline ribs 120, allowing rotation of the ratchet sleeve 116 in the second rotational direction 162. Thus, in the locked position, a ratcheting effect is possible in which the ratchet sleeve 116 is rotatable about the mop handle 102 in the second rotational direction 162, such as to tighten the twist mop assembly 112, and the ratchet sleeve is simultaneously prevented from rotating about the mop handle 102 in the second rotational direction 160. It is contemplated that, in some embodiments, the pawl and spline ribs can instead be configured to allow the ratchet sleeve to rotate in the first rotational direction with respect to the mop handle and to prevent the ratchet sleeve from rotating in the second rotational direction when in the locked position.

Figure 8:
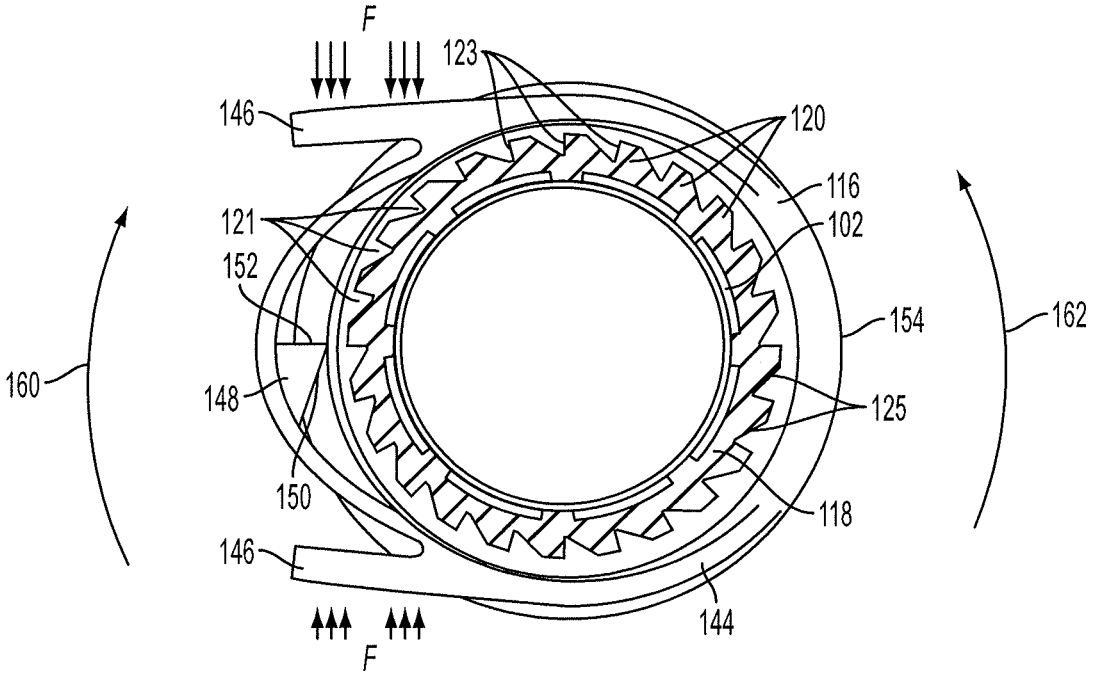
FIG. 8 is a sectional view of the mop of FIG. 1, as indicated in FIG. 5, showing the integrated pawl in an unlocked position.

FIG. 8 shows the flexible collar 144 in an unlocked position in which the pawl 148 disengages the spline ribs 120 so as to allow rotation of the ratchet sleeve 116 with respect to the mop handle 102 in both the first and second rotational directions 160, 162. The flexible collar 144 is flexed from the locked position to the unlocked position when a squeezing force, F, is applied to the tabs 146. The squeezing force F causes the flexible collar 144 in the vicinity of the pawl 148 to bow outward into a substantially ovular shape and pull the pawl out from the valleys 121 between spline ribs 120. In the unlocked position, the pawl 148 is no longer preventing rotation of the ratchet sleeve 116 with respect to the mop handle 102 in the first direction 160 because the stopping portion 152 of the pawl is now longer abutting the wall portion 123 of any spline ribs 120. Once the squeezing force F is released from the tabs 146, the flexible collar 144 is biased back into the locking position.

Figure 4:
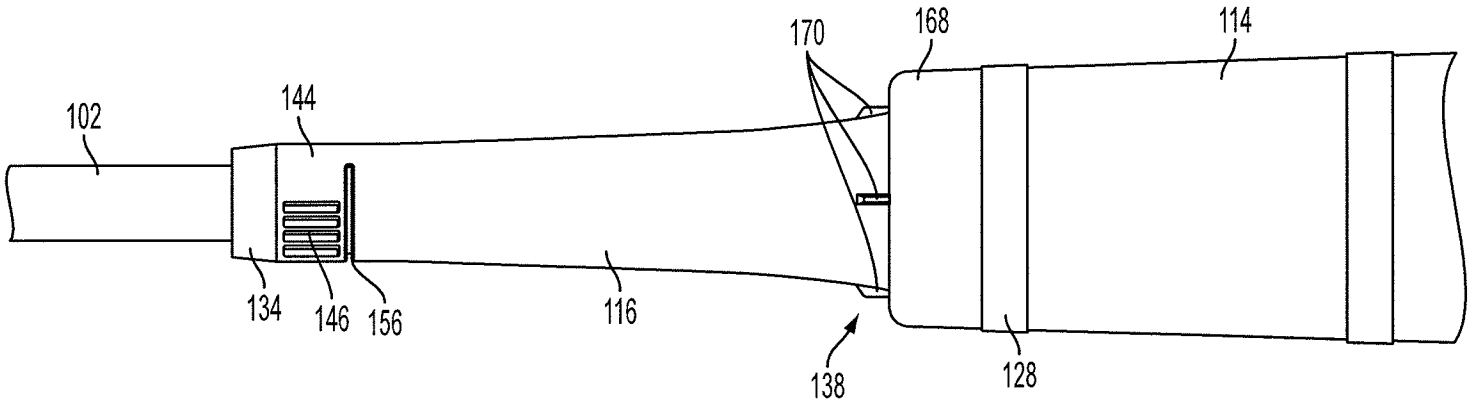
FIG. 4 is a partial front view of the mop of FIG. 1.

Referring again to FIG. 3, the mop head 114 has a first end 166 opposite a second end 168. In some embodiments, the first end 166 of the mop head 114 is connected to the mopping end 106 of the mop handle 102, and the second end 168 is connected to the ratchet sleeve 116. The mop head 114 can include a plurality of mop head bands 128 that concentrically surround the mop head to connect the plurality of strands 122 to one another. Although the illustrated embodiment shows three mop head bands 128, it is contemplated that more or fewer bands can be used in other embodiments. As shown in FIG. 4, the second end 168 of the of the mop head 114 fits over the retaining collar 142 on the ratchet sleeve 116. The second end 168 of the mop head 114 can be retained by wire, zip ties, or any other suitable retaining mechanism. In some embodiments, when the second end 168 of the mop head 114 is disposed over and around the retaining end 138 of the ratchet sleeve 116, a plurality of tightening ribs 170 can help secure the mop head in place against the retaining collar 142. The retaining collar 142 prevents the mop head 114 from sliding off of the ratchet sleeve 116 and pulls the second end 168 of the mop head toward the grip end 104 of the mop handle 102 when the ratchet sleeve is pulled toward the grip end. Additionally, the tightening ribs 170 help maintain a tight connection of the second end 168 of the mop head 114 against the ratcheting sleeve 116 so that when the ratcheting sleeve is rotated with respect to the mop handle 102, the second end of the mop head rotates along with the ratchet sleeve.

For example, FIG. 5 shows an embodiment of the mop 100 in a wringing position. In the wringing position, the flexible collar 144 and, thus, the pawl 148, is disposed adjacent the plurality of spline ribs 120 on the spline sleeve 118. When the flexible collar 144 is in the locking position, the ratchet sleeve 116 can be rotated with respect to the mop handle 102 in the second rotational direction. Because the first end 166 of the mop head 114 is connected to the mopping end 106 of the mop handle and, thus, is substantially stationary with respect to the mop handle, rotating the ratchet sleeve 116 will result in the mop head 114 twisting around the mop handle 102. As the mop head 114 is twisted, the plurality of strands 122 in the mop head will constrict against one another in a wringing action that will tend to wring water or other fluids out of the mop head. The pawl 148 then prevents the mop head 114 from untwisting itself an adequate squeezing force F is applied to the tabs 146, disengaging the pawl from the spline ribs 120 and moving the flexible collar 144 into the unlocked position. In this way, during a cleaning or mopping application, as the mop head 114 becomes soiled or otherwise saturated with fluid, the user can rotate the ratchet sleeve 116 with respect to the mop handle to wring the fluid out of the mop head strands 122.

When the mop 100 is not in the wringing position, the mop can be moved into a mopping position, such as is shown in FIG. 2, wherein ratchet sleeve 116 slides down the mop handle 102 such that the flexible collar 144 and the pawl 148 are disposed between the spline sleeve 118 and the mopping end 106 of the mop handle. In the mopping position, the strands 122 of the mop head 114 are relaxed and can more effectively engage a surface to be cleaned.

Figure 9:
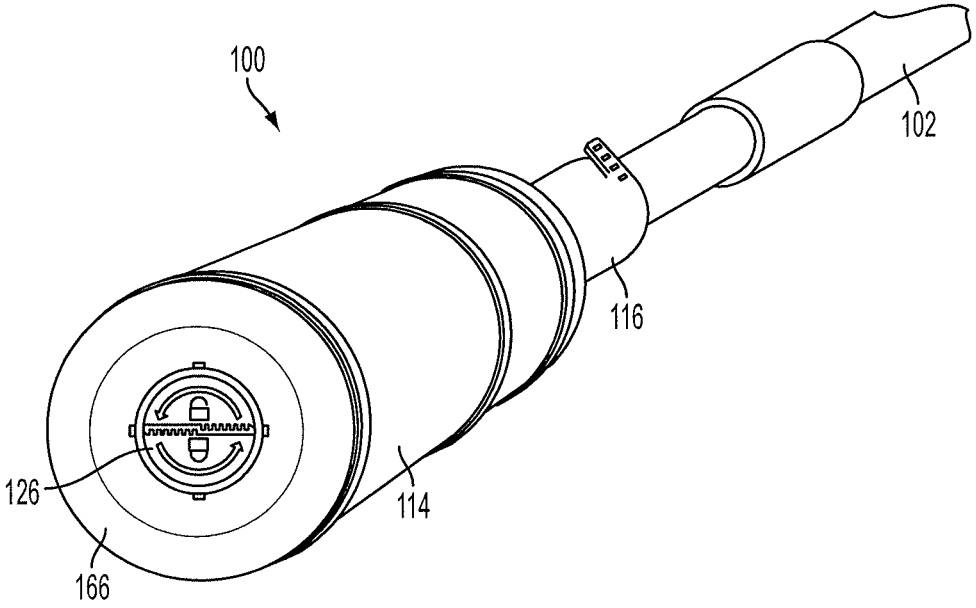
FIG. 9 is a partial perspective view of the mop of FIG. 1 showing a locking cap in accordance with the disclosure.
Figure 10:
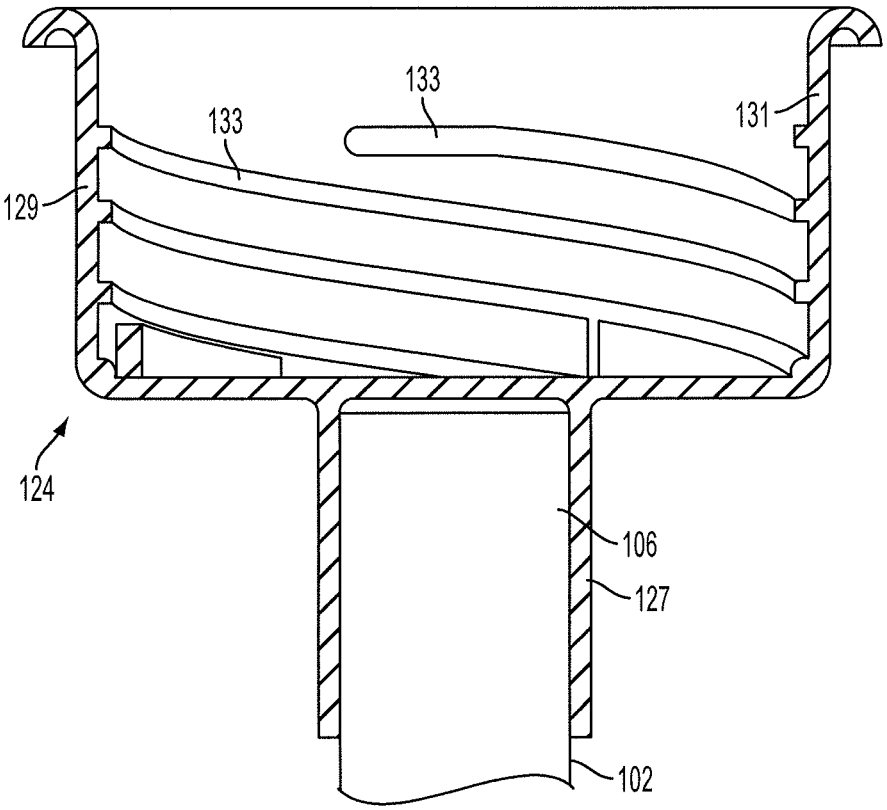
FIG. 10 is a sectional view of a locking cup of the mop of FIG. 1.
Figure 12:
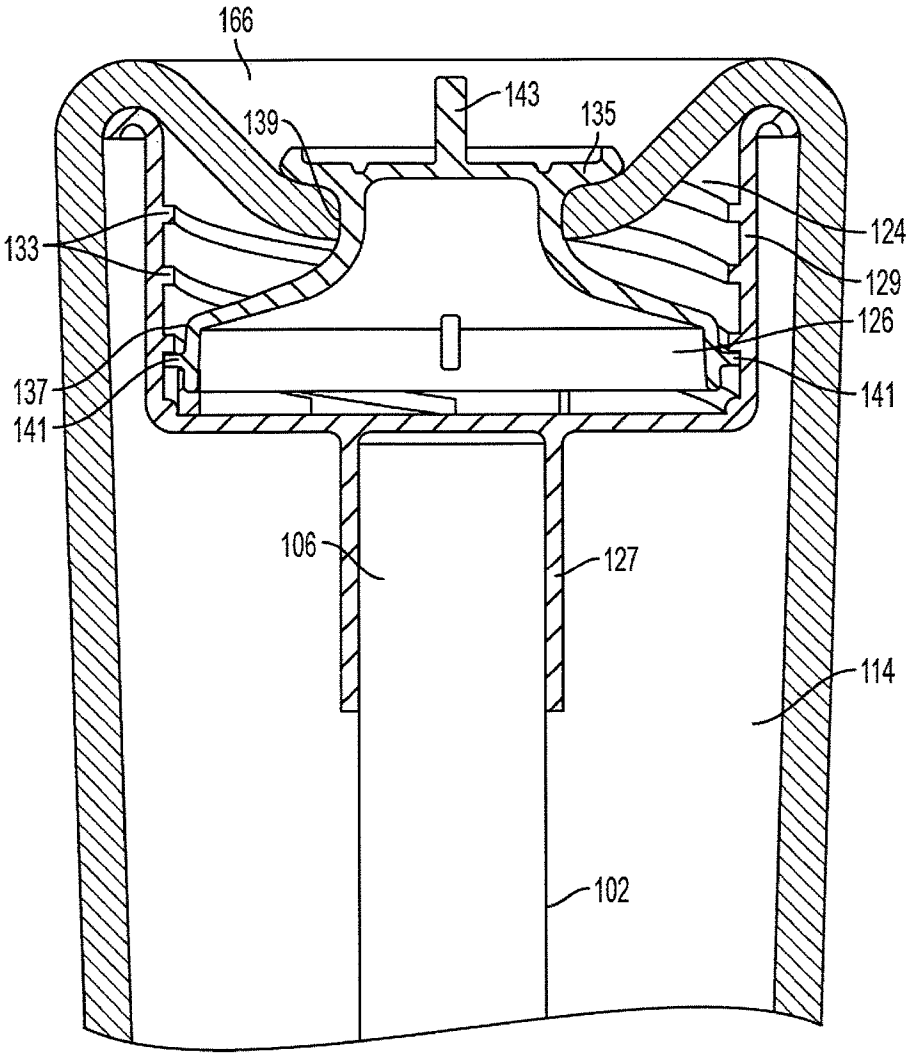
FIG. 12 is a partial sectional view of the mop of FIG. 1 showing the interaction between a locking cap, locking cup, and mop head in accordance with the disclosure.
Figure 11:
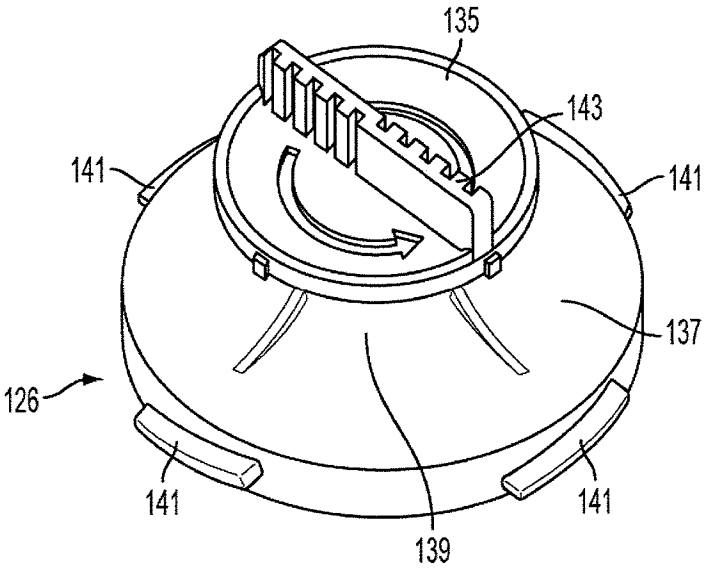
FIG. 11 is a perspective view of the locking cap of FIG. 9.

Referring again to FIG. 3, in some embodiments, the mop head 114 is secured to the mop handle 102 with an interlocking locking cup 124 and locking cap 126 combination. The locking cup and cap 124, 126 combination allows the mop head 114 to be easily secured and removed from the mop handle 102, as it may be desired to remove the mop head, for example, to clean or replace the mop head after extended use. FIG. 9 shows an embodiment of the mop 100 with the locking cap 126 securing the first end 166 of the mop head 114 to the mop handle 102. Referring now to FIGS. 10-12, the locking cup 124 has a sleeve portion 127 and a cup portion 129 opposite one another. The sleeve portion 127 is substantially tubular and can be press fit or otherwise adhered over the mopping end 106 of the mop handle 102. In some embodiments, the sleeve portion 129 can be disposed within the mop handle 102 and, in yet other embodiments, the locking cup 124 can be integral with the mop handle at the mopping end 106. Referring now particularly to FIG. 10, the cup portion 129 of the locking cup 124 has a substantially cylindrical cup interior wall 131. The cup interior wall 131 has a plurality of interior threads 133. The locking cap 126, shown in FIG. 11, is configured to selectively engage with the locking cup 124 so as to allow for selective removal of the mop head 114 from the mop handle 102. The locking cap 126 has a tab portion 135 and a locking portion 137 separated by a neck portion 139. The neck portion 139 has a substantially smaller diameter than both the tab portion 135 and the locking portion 137, resulting in a substantially hour-glass shape. The locking portion 137 of the locking cap has at least one locking tab 141 projecting radially away from the edges of the locking cap. Although the illustrated embodiment shows four locking tabs, more or fewer locking tabs are contemplated in other embodiments. The locking portion 137 of the locking cap 126 can be selectively twisted into the locking cup 124 so that the locking tabs 141 engage with the interior threads 133 of the locking cup, securing the locking cap and the locking cup to one another. The tab portion 135 of the locking cap 126 has a twisting tab 143 projecting away from the locking portion 137 that can be used to twist the locking cap into place within the locking cup 124. Although threads and locking tabs are used to secure the locking cap to the locking cup in the illustrated embodiments, other suitable attachment mechanisms are contemplated herein.

Referring now to FIG. 12, the first end 166 of the mop head 114 is secured to the locking cap 124 around the neck portion 139 of the locking cap using wire, zip ties, or any other suitable fastening mechanism. Thus, when the locking cap 126 is secured into the locking cup 124, the mop head 114 is effectively secured to the mop handle 102 via the connection between the locking cap, the locking cup, and the mopping end 106 of the mop handle 102. In some embodiments, the strands 122 on the first end 166 of the mop head 114 adjacent the tab portion 135 of the locking cap 126 are squeezed between the tab portion and the interior wall 131 of the locking cup 124 to help secure the mop head in place at the mopping end 106 of the mop handle 102.

In some embodiments, the action of wringing out the mop head 114 can result in further tightening the locking cap 126 into the locking cup 124. For example, in some embodiments, the interior threads 133 of the locking cup 124 are oriented such that the locking cap 126 is rotated in the second rotational direction 162 (as indicated in FIG. 7) to tighten the locking cap into the locking cup. As shown in FIG. 12, when the first end 166 of the mop head 114 is secured to the locking cap 126, the first ends of the strands 122 of the mop head are squeezed between the tab portion 135 of the locking cap and the interior wall 131 of the locking cup 124 when the locking cap is secured within the locking cup. Because the second end 168 of the mop head 114 is secured to the ratchet sleeve, the first end 166 of the mop head feels a rotational force in the second rotational direction when a user rotates the ratchet sleeve in the second rotational direction 162 in the act of wringing out the mop head. The friction present between the first end 166 of the mop head 114 and the locking cap 126 as the first end of the mop head is squeezed against the locking cap can cause some of that rotational force to be transferred to the locking cap. Thus, the rotation of the ratchet sleeve 116 in the second rotational direction 162 to wring out the mop head can result in at least some rotation of the locking cap 126 in the second rotational direction, further tightening the locking cap into the locking cup 124 and further securing the first end 166 of the mop head 114 to the mopping end 106 of the mop handle. In other words, when a user wrings out the mop head 114 during use, the mop head will stay secured to the mop handle; however, the user can still easily remove the mop head when desired by simply rotating the locking cap 126 in the first rotational direction 160 to disengage the locking cap from the locking cup 124.

While the arrangement is illustrated in connection with a mop, the arrangement disclosed herein has universal applicability in various other types of cleaning implements as well. It will be appreciated that the foregoing description provides examples of the disclosed system and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

We claim:

1. A mop comprising:

a mop handle with a grip end and a mopping end;

a spline sleeve disposed along the mop handle, the spline sleeve including a plurality of spline ribs disposed on the mop handle between the grip end and the mopping end, the spline ribs substantially surrounding a surface of the mop handle, and extending parallel to one another in an aligned relation substantially with a longitudinal centerline of the mop handle;

a ratchet sleeve concentrically surrounding the spline sleeve along the mop handle so as to be rotatable in first and second rotational directions with respect to the mop handle, the ratchet sleeve including a flexible collar with a single, inward-facing integral pawl disposed on an interior portion of the flexible collar facing the mop handle, the flexible collar being formed integrally with the ratchet sleeve and connected to a remaining portion of the ratchet sleeve via a bridge extending peripherally along the ratchet sleeve such that a slit extending perpendicularly relative to the longitudinal centerline at least partially through the ratchet sleeve and through the centerline is formed, the slit extending peripherally at least 180 degrees with respect to the centerline, wherein the inward-facing integral pawl is disposed diametrically opposite the bridge at a radial location disposed at a mid-point of the slit and between two tabs formed externally on the flexible collar; and a mop head disposed at the mopping end of the mop handle, the mop head having a first end connected to the mopping end of the mop handle and a second end connected to the ratchet sleeve;

wherein the flexible collar of the ratchet sleeve is flexible between a locked position, in which the pawl engages with the spline ribs so as to substantially prevent rotation of the ratchet sleeve with respect to the mop handle in the first rotational direction, and an unlocked position, in which the pawl is configured to flex from the locked position to the unlocked position when a squeezing force is applied to the two tabs such that the pawl disengages the spline ribs so as to allow rotation of the ratchet sleeve with respect to the mop handle in both the first and second rotational directions.

2. The mop of claim 1, wherein the flexible collar of the ratchet sleeve is biased toward the locked position.

3. The mop of claim 1, wherein, in the locked position, the ratchet sleeve is rotatable in the second rotational direction.

4. The mop of claim 1, wherein the spline sleeve further includes a stop ring and a locking ring disposed at an end of the spline sleeve opposite the mopping end, the locking ring being smooth, having a smaller diameter than the plurality of spline ribs and disposed between the stop ring and the plurality of spline ribs, and wherein the ratchet sleeve is slidable along the mop handle between a locked position, in which the inward-facing integral pawl is slidably disposed over the locking ring, a wringing position, in which the pawl is disposed adjacent the plurality of spline ribs, and a mopping position, in which the pawl is disposed between the spline ribs and the mopping end of the mop handle.

5. The mop of claim 1, wherein the mop head comprises a plurality of strands running from the first end to the second end of the mop head.

6. The mop of claim 5, wherein the mop head further comprises a plurality of mop head bands surrounding the mop head and connecting the plurality of strands to one another.

7. The mop of claim 1, wherein the flexible collar includes two tabs disposed diametrically opposite from one another around the flexible collar, the pawl being disposed on the flexible collar between the two tabs opposite the bridge such that the tabs are squeezable toward one another to flex the flexible collar from the locked position to the unlocked position.

8. The mop of claim 1, wherein the first end of the mop head is connected to a locking cap that is selectively removable from the mopping end of the mop handle.

9. The mop of claim 8, wherein the mopping end of the mop handle includes a locking cup configured to lockingly receive the locking cap.

10. The mop of claim 9, wherein the locking cup includes interior threads configured to matingly engage with the locking cap when the locking cap is rotated in the second rotational direction with respect to the mop handle, and wherein rotating the ratchet sleeve in the second rotational direction rotates the locking cap in the second rotational direction via the mop head.

11. A mop comprising:

a mop handle with a grip end and a mopping end;

a locking cup disposed on the mopping end of the mop handle;

a spline sleeve disposed along the mop handle, the spline sleeve including a stop ring and a locking ring disposed on an end opposite the mopping end;

a ratchet sleeve concentrically surrounding the mop handle and the spline sleeve so as to be rotatable and slidable with respect to the mob handle and the spline sleeve; and a mop head having a first end connected to a locking cap and a second end connected to the ratchet sleeve;

wherein the locking cap is configured to selectively engage with the locking cup so as to allow for selective removal of the mop head from the mop handle; and wherein the ratchet sleeve includes a flexible collar that is integrally formed and includes a single pawl disposed between two tabs formed externally on the flexible collar, a bridge extending peripherally relative to the ratchet sleeve and connecting the flexible collar with a remaining portion of the ratchet sleeve, the bridge disposed diametrically opposite the pawl along the flexible collar, such that a slit extending perpendicularly relative to a longitudinal centerline of the mop handle, at least partially through the ratchet sleeve and through the centerline is formed, the slit extending peripherally at least 180 degrees with respect to the centerline, wherein the two tabs are disposed diametrically opposite one another and between the pawl and the bridge, and wherein the flexible collar is configured to flex from a locked position, in which the single pawl engages the ratchet sleeve, to an unlocked position, in which the single pawl is disengaged from the ratchet sleeve, when a squeezing force is applied to the two tabs.

12. The mop of claim 11, wherein the locking cup includes interior threads configured to matingly engage with the locking cap.

13. The mop of claim 12, wherein the locking cap includes at least one locking tab configured to engage with the interior threads of the locking cup to secure the locking cap to the locking cup.

14. The mop of claim 11, wherein the ratchet sleeve includes a retaining collar that prevents movement of the second end of the mop head toward the mopping end of the mop handle with respect to the ratchet sleeve.

15. The mop of claim 11, further comprising a plurality of spline ribs disposed on the mop handle between the grip end and the mopping end, the spline ribs substantially surrounding a surface of the mop handle and aligned substantially with the mop handle, and wherein the flexible collar is flexible between a locked position in which the pawl engages with the spline ribs so as to substantially prevent rotation of the ratchet sleeve with respect to the mop handle in a first rotational direction, and an unlocked position in which the pawl disengages the spline ribs so as to allow rotation of the ratchet sleeve with respect to the mop handle in the first rotational direction and a second rotational direction.

16. The mop of claim 15, wherein the flexible collar of the ratchet sleeve is biased toward the locked position.

17. The mop of claim 15, wherein the ratchet sleeve is slidable along the mop handle between a wringing position in which the pawl is disposed adjacent the plurality of spline ribs, and a mopping position in which the pawl is disposed between the spline ribs and the mopping end of the mop handle.

18. The mop of claim 11, wherein the mop head comprises a plurality of strands running from the first end to the second end of the mop head, and the mop head further comprises a plurality of mop head bands surrounding the mop head and connecting the plurality of strands to one another.

19. A mop comprising:

a mop handle with a grip end and a mopping end;

a locking cup disposed on the mopping end of the mop handle;

a spline sleeve connected along the mop handle and forming a plurality of spline ribs disposed between the grip end and the mopping end, the spline ribs substantially surrounding a surface of the mop handle and aligned substantially with the mop handle;

a ratchet sleeve concentrically surrounding the mop handle so as to be rotatable with respect to the mob handle, the ratchet sleeve including a flexible collar with a single, inward-facing integral pawl disposed on an interior portion of the flexible collar facing the mop handle and between two tabs formed externally on the flexible collar, the flexible collar being formed integrally with the ratchet sleeve and connected to a remaining portion of the ratchet sleeve via a bridge extending peripherally relative to the ratchet sleeve such that a slit extending perpendicularly relative to the longitudinal centerline at least partially through the ratchet sleeve and through the centerline is formed, wherein the inward-facing integral pawl is disposed diametrically opposite the bridge; and a mop head having a first end connected to a locking cap and a second end retained around the ratchet sleeve, the locking cap being configured to selectively engage with the locking cup so as to allow for selective removal of the mop head from the mop handle;

wherein the flexible collar is biased toward a locked position in which the pawl engages with the spline ribs so as to substantially prevent rotation of the ratchet sleeve in a first rotational direction with respect to the mop handle, and wherein the flexible collar is flexible into an unlocked position in which the pawl disengages the spline ribs so as to allow rotation of the ratchet sleeve with respect to the mop handle in the first rotational direction and a second rotational direction when a squeezing force is applied to the two tabs to flex the flexible collar from the locked to the unlocked position.

20. The mop of claim 19, wherein the locking cup includes interior threads and the locking cap and includes at least one locking tab configured to engage with the interior threads of the locking cup to secure the locking cap to the locking cup, and wherein the ratchet sleeve is slidable along the mop handle between a wringing position in which the pawl is disposed adjacent the plurality of spline ribs, and a mopping position in which the pawl is disposed between the spline ribs and the mopping end of the mop handle.

21. The mop of claim 7, wherein the flexible collar has a wall thickness that varies peripherally around the flexible collar from a thicker wall thickness dimension adjacent the bridge to a thinner wall thickness dimension adjacent the inward-facing integral pawl.

22. The mop of claim 11, wherein the flexible collar has a wall thickness that varies peripherally around the flexible collar from a thicker wall thickness dimension adjacent the bridge to a thinner wall thickness dimension adjacent the pawl.

23. The mop of claim 19, wherein the flexible collar has a wall thickness that varies peripherally around the flexible collar from a thicker wall thickness dimension adjacent the bridge to a thinner wall thickness dimension adjacent the inward-facing integral pawl.

* * * * *